United States Patent [19]

Barkow

[11] 4,231,009

[45] Oct. 28, 1980

[54] DEFLECTION YOKE WITH A MAGNET FOR REDUCING SENSITIVITY OF CONVERGENCE TO YOKE POSITION

[75] Inventor: William H. Barkow, Pennsauken, N.J.

[73] Assignee: RCA Corporation, New York, N.Y.

[21] Appl. No.: 938,243

[22] Filed: Aug. 30, 1978

[51] Int. Cl.[3] ..... H01F 7/00

[52] U.S. Cl. ..... 335/212; 335/210

[58] Field of Search ..... 335/210, 211, 212, 213, 335/214

[56] References Cited

U.S. PATENT DOCUMENTS

| | | | |
|---|---|---|---|
| 2,921,213 | 1/1960 | Reiches | 313/413 |
| 3,873,953 | 3/1975 | Puhak | 335/212 |
| 4,100,518 | 7/1978 | Smith | 335/212 |
| 4,145,677 | 3/1979 | Maruyama et al. | 335/212 |

*Primary Examiner*—George Harris

*Attorney, Agent, or Firm*—Eugene M. Whitacre; William H. Meise; Scott J. Stevens

[57] ABSTRACT

A deflection yoke of the self-converging type uses pincushion-shaped horizontal deflection fields and barrel-shaped vertical deflection fields for converging three in-line electron beams and includes a first pair of magnets disposed near the top and bottom of the beam exit end of the yoke. Each magnet is poled to produce a field having the same polarity as the vertical deflection field during the interval in which the electron beam is deflected towards the magnet. A second pair of magnets is disposed at the top and bottom of the inside of the flared inner surface of the yoke at a generally central position between the beam entrance and beam exit ends of the yoke, each of which is poled for producing a field of a polarity opposite to that of the vertical deflection field when deflecting the beam towards the respective magnet. The first and second magnet pairs coact to correct North-South pincushion distortion without substantial effect on the convergence. A third pair of magnets is disposed at the top and bottom of the inside flare of the yoke between the beam entrance end of the yoke and the second pair of magnets and is poled in the same direction as the first magnet pair. The third magnet pair reduces the sensitivity of the convergence to the position of the deflection yoke relative to the electron beams.

11 Claims, 7 Drawing Figures

DEFLECTION YOKE WITH A MAGNET FOR REDUCING SENSITIVITY OF CONVERGENCE TO YOKE POSITION

This invention relates to self-converging color kinescope display systems requiring reduced alignment between the deflection yoke and the kinescope.

Color television kinescopes or picture tubes create images having portions of different colors by causing electrons to impinge upon or illuminate phosphors having different emissions. Normally, phosphors having red, green and blue light emission are used, grouped into myriad trios or triads of phosphor areas, with each triad containing one phosphor area of each of the three colors.

In the kinescope, the phosphors of each of the three colors are illuminated by an electron beam which is intended to impinge upon phosphors of only one color. Thus, each electron beam may be identified by the name of the color emitted by the phosphor which the beam is intended to illuminate, even though the electron beam itself is devoid of color. Each electron beam has a relatively large cross-section compared with a phosphor triad, and each beam illuminates several triads. The three electron beams are generated by three electron guns located in a neck portion of the kinescope opposite the viewing screen formed by the phosphors. The electron guns are oriented so that the beams as generated leave the guns in parallel or somewhat converging paths directed towards the viewing screen. In order to allow the display of a gamut of colors, the phosphor array in a given area must be illuminated by the three electron beams with an intensity dependent upon the color to be displayed. The three electron beams leaving the electron guns in separate parallel paths will if uncorrected illuminate the viewing screen in three different locations, forming separated dots of different colors. In order to enable a single illuminated area to display a color gamut, the electron beams are caused to converge at or near the viewing screen. At the center of the screen, this may be accomplished by the use of a permanent magnet assembly mounted in the neck region of the kinescope for producing a static magnetic field which causes the three beams to converge or register at the center of the viewing screen. This adjustment is known as "static convergence".

With the three electron beams illuminating the same area of the viewing screen, some means must be provided for causing each of the red, green and blue beams to illuminate only its respective phosphor. This is accomplished by the shadow mask. The shadow mask is a conductive screen or grill having large numbers of perforations through which portions of the electron beams may pass. Each perforation is in a fixed position relative to each triad of color phosphor areas. Portions of the converged electron beams pass through one or more of the perforations and the portions begin to diverge and separate as they approach the viewing screen. At the viewing screen the portions are separated and fall upon the appropriate phosphor color based upon the direction of electron beam incidence. That is, each electron beam approaches a given group of perforations from a slightly different direction and the beams are split into a number of smaller beams which diverge slightly after passing through the perforation and before falling upon the appropriate individual color phosphor areas. The method depends upon a high order of accuracy in the placement of the phosphor triads relative to the perforations and the apparent source of the electron beams. In order to insure that the apparent source of the electron beams is correct, a "purity" adjustment is made by which each beam is caused to illuminate only a particular one of the phosphor areas of each triad.

In order to form a two-dimensional image, the lighted dot on the viewing screen caused by the three statically converged electron beams must be moved both horizontally and vertically over the viewing screen to form a lighted raster area. This is accomplished by means of magnetic fields produced by a deflection yoke mounted upon the neck of the kinescope. The deflection yoke commonly deflects the electron beam with substantially independent horizontal and vertical deflection systems. Horizontal deflection of the electron beam is provided by pairs of conductor arrays of the yoke which produce a magnetic field having vertically extending field lines. The amplitude of the magnetic field is varied with time at a relatively high rate. Vertical deflection of the electron beams is accomplished by pairs of conductor arrays producing a horizontally extending magnetic field which varies with time at a relatively low rate.

A permeable magnetic core is associated with the yoke conductors. The conductors are formed into continuous windings or coils by return conductors which may enclose the core within the coil to form a toroidal deflection winding, or which form a saddle coil winding if the coil does not enclose the core.

The viewing screen is relatively flat. The electron beam, traverses a given distance from the point or center of deflection to the center of the viewing screen, will traverse a greater distance when deflected towards the edge of the viewing screen. From geometrical considerations, it may be expected that the electron beams will converge at a point on the surface of a sphere centered at the point of deflection. This alone would result in a separation of the landing points of the three electron beams near the edge of the screen. In addition, unavoidable longitudinal components of the deflecting magnetic fields cause the electron beams to be more strongly converged whereby the surface at which the beams converge is further distorted. These effects combine to cause the light spots generated by the three beams at points away from the center of the viewing screen to be separated, even though each of the beams illuminates only its appropriate color phosphor. This is known as misconvergence, and results in color fringes about the displayed images. A certain amount of misconvergence is tolerable, but complete separation of the three illuminated spots is generally not. Misconvergence may be measured as a separation of the ideally superimposed red, green and blue lines of a crosshatch pattern of lines appearing on the raster as an appropriate test signal is applied to the receiver.

Formerly, kinescopes had the electron guns in a triangular or delta configuration. Convergence of the electron beams to form a coalesced light spot at points away from the center of the viewing screen was accomplished in delta-gun systems by dynamic convergence arrangements including additional convergence coils mounted about the neck of the kinescope and driven at the deflection rates by dynamic convergence circuits, as described in U.S. Pat. No. 3,942,067 issued Mar. 2, 1976 to Cawood.

As described in U.S. Pat. No. 3,789,258 issued Jan. 29, 1974 to Barbin, and in U.S. Pat. No. 3,800,176 issued Mar. 26, 1974 to Gross and Barkow, current television display arrangements utilize an in-line electron gun assembly together with a self-converging deflection yoke arrangement including deflection windings for producing negative horizontal isotropic astigmatism and positive vertical isotropic astigmatism for balancing the convergence conditions of the beams on the deflection axes and in the corners such that the beams are substantially converged at all points on the raster. This eliminates the need for dynamic convergence coils and circuits. With the increased deflection angles necessitated by commercially desirable short kinescopes, the deflection yoke is required to correct for pincushion and other raster distortions as well as providing satisfactory self-convergence. The magnetic field nonuniformity providing the isotropic astigmatism necessary for self-convergence makes the convergence dependent upon the position of the longitudinal axis of the yoke relative to the longitudinal axis of the kinescope. This sensitivity together with normal manufacturing tolerances makes it necessary to adjust the yoke transversely relative to the kinescope to achieve the best compromise convergence.

SUMMARY OF THE INVENTION

A self-converging deflection yoke assembly for use with a wide-angle in-line color television kinescope includes means for producing deflection fields having a nonzero average nonuniformity for substantially converging the electron beams at all points on the raster, and also having a region about the entrance end of said yoke in which the average field nonuniformity is substantially zero for reducing the effect of yoke positioning relative to said electron beams.

DESCRIPTION OF THE INVENTION

Figure 1:
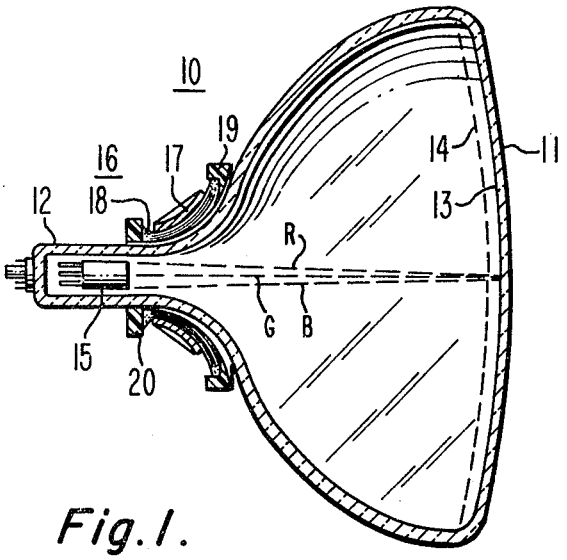
FIG. 1 is a plan view of a section of a display system embodying the present invention.

In FIG. 1, a color television picture tube 10 includes a faceplate 11 upon which are deposited repeating groups of red, green and blue phosphor trios 13. A shadow mask 14 is located inside the tube and is spaced from faceplate 11. An electron gun assembly 15 is mounted in the neck portion 12 of the tube opposite the faceplate. Gun assembly 15 produces three horizontal in-line beams R, G and B. A deflection yoke assembly designated generally as 16 is mounted around the neck and flared portion of the tube by a suitable yoke mount 19. Yoke 16 also includes a flared ferrite core 17 and vertical and horizontal deflection coils 18. Deflection yoke 16 is of the aforementioned self-convergence type. A static convergence and purity magnet assembly 20 is mounted around neck portion 12 of the tube.

Figure 2:
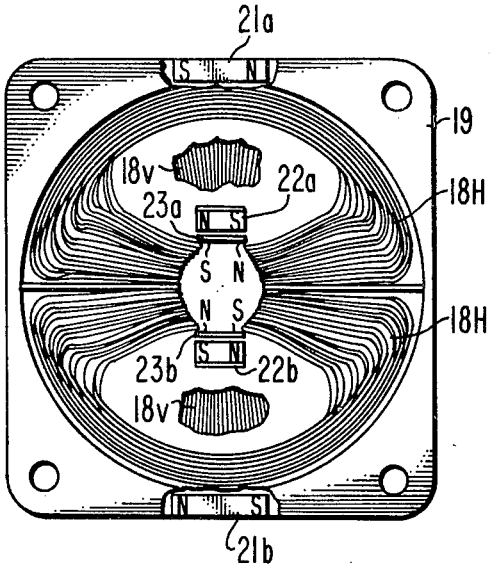
FIGS. 2 and 3 illustrate a deflection yoke embodying the present invention.
Figure 3:
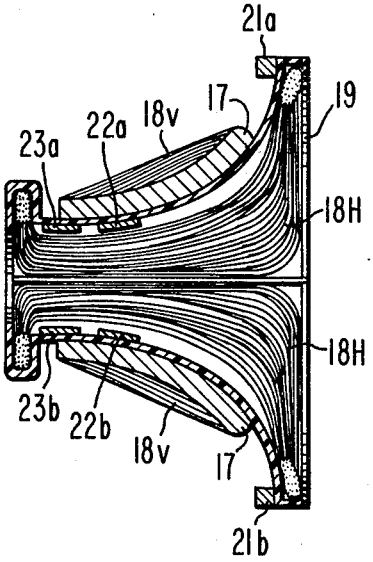

FIGS. 2 and 3 illustrate in greater detail a deflection yoke 16 embodying the present invention. A plastic yoke mount 19 serves to hold a pair of saddle-type horizontal deflection coils 18H in proper orientation relative to flared ferrite core 17 around which a vertical deflection winding 18V is wound. Thus, in this example, deflection yoke 16 is a saddle-toroid (ST) type. In FIG. 2 the yoke assembly is viewed from the electron-beam exit side and in the side view illustrated in FIG. 3, the beam-exit side is on the right. In FIGS. 2 and 3, a magnetic field producing means illustrated as a pair of magnets **21*a* and 21*b* is mounted near the top and bottom of the yoke at the front or beam-exit portion of the yoke. The magnets are affixed in a recess in mount 19** and are poled as indicated (although manufacturing drawings sometimes use a reverse convention so that a compass can be used as an indicator).

A second flux altering means illustrated as a pair of magnets **22*a* and 22*b* is disposed adjacent to the flared inner surface of the yoke at the top and bottom somewhat towards the beam-entrance end of the central portion of the length of the yoke. The magnets are poled as indicated. These magnets are surface-magnetized permanent magnets of a low-permeability material such as barium ferrite dispersed in a soft plastic matrix. The magnets are mounted by adhesive to an insulating layer of mount 19 which separates the vertical and horizontal deflection windings, and conform to the contour of the insulator. Flux altering means 22*a* and 22*b*** may also comprise nonmagnetized pieces of magnetically permeable material such as silicon steel.

A third magnetic field producing means illustrated as a pair of magnets **23*a* and 23*b* is disposed adjacent the flared inner surface of the yoke at the top and at the bottom between the beam-entrance end of the yoke and the second flux altering means. Magnets 23 are similar to magnets 22 and are mounted in the same manner. The purpose of magnetic field producing means 21 and 23 and flux altering means 22 can best be described in conjunction with FIGS. 4–7**.

Figure 4:
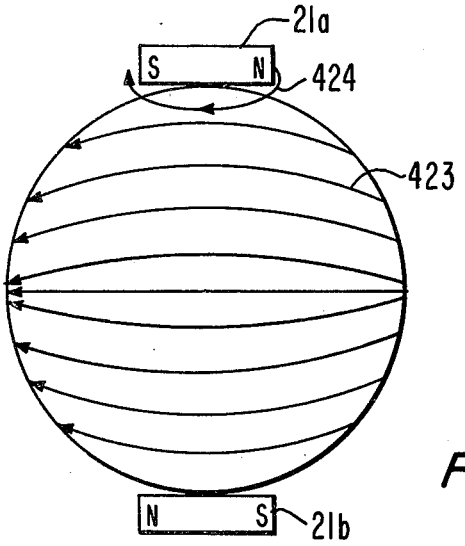
FIGS. 4 and 7 illustrate magnetic fields associated with the yokes of FIGS. 2 and 3.

FIG. 4 represents the vertical deflection field structure in the region inside the yoke flare at a transverse cross-section of the yoke of FIG. 3 near magnet 21, as viewed from the beam exit end of the deflection yoke. The vertical deflection field lines 423 are illustrated in the condition in which the electron beams are deflected upwards from the center of the screen and the invention is explained in this context. Although not shown, it should be understood that the principles of the invention are equally applicable for the opposite polarity vertical deflection field which deflects the beams downward. Line 424 represents one of the many magnetic flux lines produced by magnet **21*a*. Flux lines 423 of FIG. 4** are barrel-shaped at the particular transverse cross-section illustrated.

Figure 5:
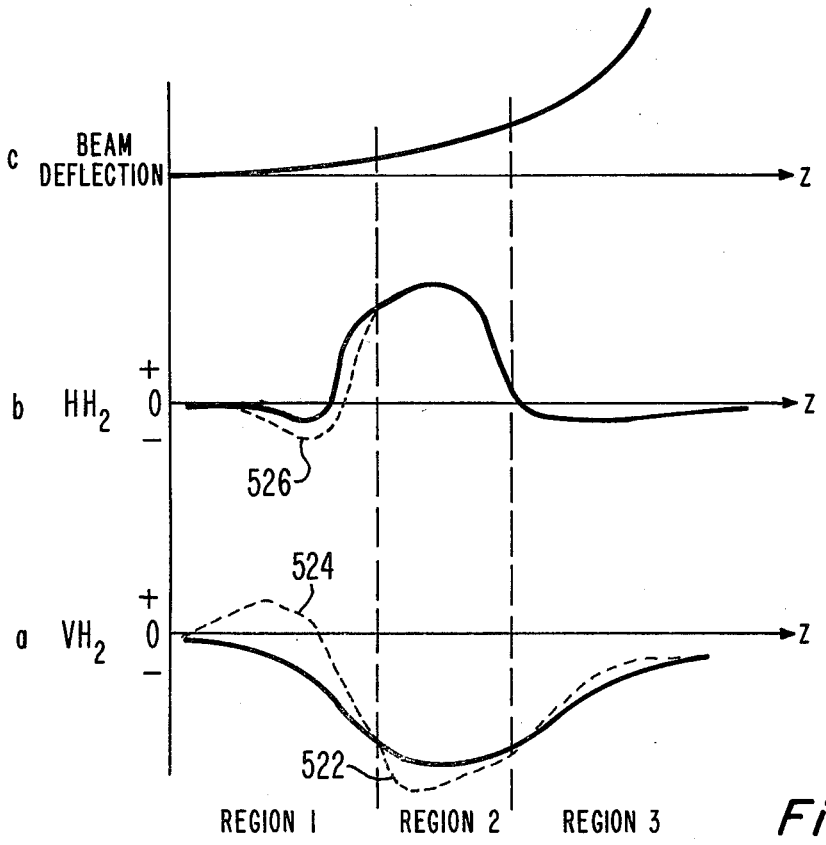
FIGS. 5 and 6 illustrate magnetic forces and flux gradients with associated beam trajectory curves, respectively, useful in explaining the invention.

The amount of deviation from a uniform field at various cross-sections along the longitudinal axis of the yoke may be represented by a plot of the nonuniformity function H2 parallel to the axis of the yoke. The nonuniformity of the field as represented in FIG. 5 is normalized to the amplitude of the H0 or uniform element of the magnetic field, and the illustrated H2 function is therefore independent of time-dependent variations in H0. In FIG. **5*a*, the vertical deflection field nonuniformity curve VH2 lines entirely in the negative H2 region. Curve VH2 represents a field which is strongly barreled in region 2 about the mid-portion of the yoke, and which is less strongly barreled in regions 1 and 3, representing the regions about the entrance and exit ends, respectively, of the yoke. Such a barreled field is typical of the vertical deflection field produced by a conventional self-converging yoke. In FIG. 5*b*, solid curve HH2 represents the nonuniformity function of the horizontal deflection fields produced by a conventional self-converging deflection yoke. As illustrated, in region 1 the field is both barreled and pincushion-shaped, in region 2, strongly pincushion-shaped, and in region 3 slightly barrel-shaped. FIG. 5***c* illustrates the relative deflection which an electron beam undergoes in passing through regions 1, 2 and 3. A principal portion of the deflection has occurred before region 3, and very little occurs in region 1.

Figure 6:
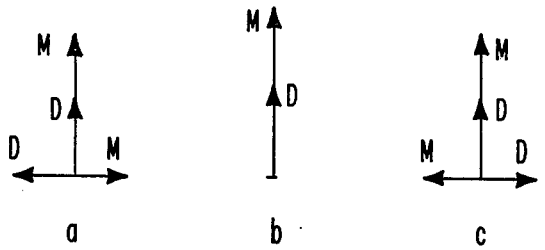

FIG. 6 represents the force vectors applied to an electron beam emerging from the plane of the paper in FIG. 4 under the influence of the vertical deflection fields for the left, center and rightsides of the raster. In FIG. 6, the vectors D represent the force components resulting from the barrel-shaped vertical deflection field. Vectors M represent forces resulting from the magnetic field of magnet 21*a*. At the center of the screen, magnetic field lines 423 and 424 are tangent and therefore the two vectors D and M simply add as illustrated in FIG. 6*b*. At the left and right portions of the screen, field lines 423 and 424 are not tangent but are curved away from each other, and the resulting forces are illustrated in FIGS. 6*a* and 6*c* as being resolved into vertical-acting and horizontal-acting forces. It can be seen that the upward deflection force is greatest at the center of the raster and less at the left and right extremes, and that the force vectors of FIG. 6 are adapted to correcting top-bottom pincushion correction. Since raster distortion is a function of the square of the electron beam deflection from the undeflected path, and since deflection is greatest near the exit end of the yoke as illustrated in FIG. 5*c*, raster distortion correction measures are most effective at this location. Consequently, magnet 21*a* disposed near the beam exit end of the yoke is used to correct North-South (top-bottom) pincushion distortion. The force vectors illustrated in FIG. 6 provide the greatest deflection force near the center of the top of the raster and least near the sides of the raster, indicating that the vertical deflection field structure of FIG. 4 resulting from the placement and polarity of magnets 21 illustrated in FIGS. 2 and 3 is suited to the correction of pincushion distortion. However, the polarity and location of magnets 21 reduces the barreling of the vertical deflection field necessary to provide proper convergence.

In order to compensate for the convergence error introduced by magnets 21, magnets 22 are introduced near the locations illustrated in FIGS. 2 and 3. The polarity of magnets 22 is opposite to that of magnets 21. The introduction of a magnetic field opposing the vertical deflection field has the effect of enhancing the barreling of the total magnetic field, or as illustrated in FIG. 5*a* in region 2 changes nonuniformity function VH2 in a negative direction as illustrated by dotted curve portion 522. The strength of magnets 22 is adjusted together with that of magnets 21 to provide pincushion correction together with proper convergence over the raster. Magnets 22 have less effect on raster distortion because the electron beam deflection in region 2 is small relative to that in region 3, and as mentioned the raster distortion resulting from a magnetic action at a location is proportional to the square of the deflection at the location.

However, magnet 22*a* is relatively near magnet 22*b* as illustrated in FIG. 2. A vertical magnetic field is set up between mutually opposite poles of the pair, and the total field produced by magnets 22 may be recognized as a quadrupole. The vertical-extending field increases the pincushion curvature of the horizontal deflection field and may adversely affect static convergence.

The static magnetic field affects the static convergence in much the same manner that the quadrupole field of the beam bender does. The static center convergence in the presence of magnets 22 must be corrected with the beam bender.

The foregoing arrangement of magnets 21 and 22 provides satisfactory results and is as described in application Ser. No. 913,239 filed June 6, 1978 in the name of William H. Barkow.

In many color display systems utilizing the self-converging principle, optimum convergence of the beams is achieved by adjusting the lateral or transverse position of the deflection yoke on the neck of the picture tube. It has been discovered that by the use of magnets 23 having the same polarity as magnets 21 that the alignment can be simplified. A deflection yoke as illustrated in FIGS. 2 and 3 including magnets 23 requires simplified transverse adjustment to achieve proper convergence over the entire raster, because no compromise is required between major and minor axis convergence. If the deflection field of the yoke were uniform (H2=0), the convergence would be relatively unchanged by translation of the yoke relative to the kinescope. However, a uniform field cannot provide self-convergence, since the nonuniformity of the field provides the differential deflection of the beam which is necessary for convergence. It has been discovered, however, that if the average or net nonuniformity near the entrance end of the yoke is near zero, that the convergence is substantially independent of the transverse positioning of the yoke relative to the kinescope in at least one plane.

Referring to FIG. 5*a*, the effect of magnets 23 is to reduce the barreling of the vertical fields to such an extent that a pincushion-shaped portion results, as illustrated by dotted curve 524.

Figure 7:
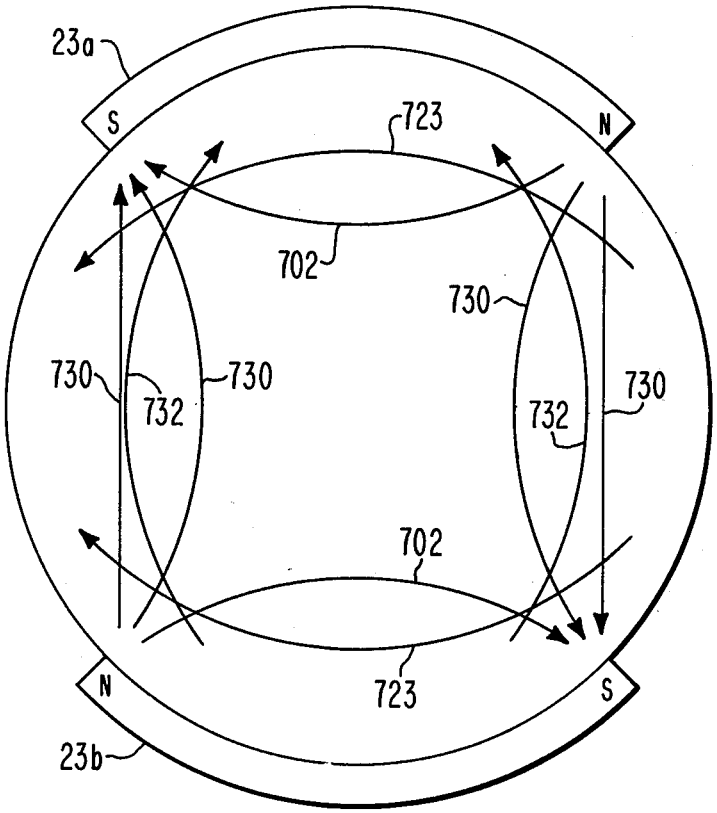

FIG. 7 represents the deflection field structure at a transverse cross-section near the entrance end of the yoke as viewed from the exit end when the electron beam is deflected upwards and to the right of center. Magnetic field lines 702 extend generally horizontally from the North to the South pole of magnet 23*a*. Vertical deflection field lines 723 are barrel-shaped and also extend in a generally horizontal direction. Field lines 702 when added to lines 723 form a total vertical deflection field which is less barreled than the unmodified deflection field. As illustrated by dotted line 524 in region 1 of FIG. 5*a*, the addition of magnets 23 modifies the originally all-negative VH2 function to a function which is partially positive and partially negative in the vicinity of the entrance end of the yoke, with an average of approximately zero.

In FIG. 7, the generally vertically extending field lines 730 generated by magnet pair 23 when added to the generally barrel-shaped horizontal deflection field lines 732 increases the barrel nonlinearity of the horizontal deflection field, resulting in a horizontal H2 curve modified as illustrated by dashed curve 526 in FIG. 5*b*. The average nonlinearity of the horizontal deflection field in the presence of magnets 23 is approximately zero, as illustrated by the sum of the positive and negative regions under curve 526. Consequently, the convergence is relatively unaffected by the exact location at which the electron beams enter the yoke fields.

The simplified adjustment of the yoke of FIGS. 2 and 3 is accomplished by adjusting the yoke vertically relative to the kinescope to obtain a straight horizontal line through the center of the raster from the center electron beam and adjusting the yoke horizontally to obtain equal heights of the rasters formed by the outside electron beams.

Magnet set 23 when used in conjunction with magnet set 22 must have a magnetic strength great enough to produce an average nonuniformity of zero in entrance region 1. Since magnet set 22 tends to increase the negative or barrel nonuniformity of the vertical deflection fields and positive or pincushion nonlinearity of the horizontal deflection fields, magnet set 23 must be stronger in the presence of magnet set 22 then if used alone in order to bring the average entrance-region nonuniformity to zero. Magnet set 23 may be used alone to reduce the position sensitivity of convergence of a self-converging yoke, in which case the field strength produced by magnets 23 need not be as great as in the presence of magnets 22. Depending upon the average entrance-region nonuniformity of the yoke, magnet set 23 may require polarization in a direction opposite to that illustrated when used alone.

The described static quadrupole field generated by magnet set 23 combined with a deflection field of variable amplitude creates a field distribution having a shape which varies with scanning current or time. The shape of the deflection field is thus modified as required at each deflection angle so as to provide a greater control over each point on the scanned raster. The dynamic field distribution results in a commercially distortion-free North-South pattern and substantial convergence for large-screen wide-angle displays.

It will be apparent to those skilled in the art that the functions of magnets 22*a* and 23*a* may be provided by a single strip of ferrite material surface-magnetized with two north and two south poles at locations corresponding to those illustrated in FIG. 2.

What is claimed is:

1. A self-converging deflection yoke assembly for use with a wide-angle in-line color television kinescope, comprising:

means for producing deflection fields having a non-zero average nonuniformity for substantially converging the electron beams at all points on the raster, and also having a region about the entrance end of said yoke in which the average field nonuniformity is substantially zero for reducing the effect of yoke positioning relative to said electron beams.

2. A yoke according to claim 1 wherein said means for producing deflection fields comprises:

a deflection winding for producing a magnetic field having a time-variant amplitude for progressive deflection of said electron beams; and first static magnetic field producing means disposed near said entrance end of said yoke for producing a static magnetic field which sums with said time-variant magnetic field in such a manner as to produce a time-variant field distribution in the vicinity of said entrance end of said yoke in which said average field nonuniformity is substantially zero.

3. A yoke according to claim 2 wherein said first static field producing means is disposed adjacent said deflection winding along the inside flare of said yoke.

4. A yoke according to claim 3 wherein said first static field producing means comprises a first magnet.

5. A yoke according to claim 4 wherein said first magnet is a permanent magnet.

6. A yoke according to claim 4 wherein said first magnet is disposed near said entrance end of said yoke.

7. A self-converging deflection yoke assembly for use with a wide-angle in-line color television kinescope, comprising:

means for producing deflection fields having a non-zero average nonuniformity for substantially converging the electron beams at all points on the raster, and also having a region about the entrance end of said yoke in which the average field nonuniformity is substantially zero for reducing the effect of yoke positioning relative to said electron beams, wherein said means for producing deflection fields comprises:

a deflection winding for producing a magnetic field having a time-variant amplitude for progressive deflection of said electron beams; and first static magnetic field producing means disposed near said entrance end of said yoke for producing a static magnetic field which sums with said time-variant magnetic field in such a manner as to produce a time-variant field distribution in the vicinity of said entrance end of said yoke in which said average field nonuniformity is substantially zero, wherein said first static field producing means is disposed adjacent said deflection winding along the inside flare of said yoke and comprises a first magnet disposed near said entrance end of said yoke, and wherein said first static field producing means comprises a second permanent magnet disposed adjacent said deflection winding along the inside flare of said yoke diametrically opposite said first magnet.

8. A yoke according to claim 7 wherein said first and second magnets are poled for producing fields near the top and bottom, respectively, of said inside flare of said yoke which fields are of the same polarity as the fields produced by said vertical winding during those intervals in which said electron beams are deflected towards the top and bottom, respectively, of said yoke.

9. A yoke assembly according to claim 8 further comprising:

second static magnetic field producing means disposed near the top and bottom of the beam-exit end of said yoke for producing fields poled the same as the fields of said first static field producing means; and third field producing means disposed at the top and bottom of said inside flare of said yoke adjacent said winding at a position between said first and second static field producing means for adding a barrel-shaped component to said field produced by said vertical deflection winding for coacting with said second field producing means for correcting raster distortion and for coacting with said first field producing means for reducing the sensitivity of the convergence to the path of said beams through said yoke.

10. A self-converging deflection yoke assembly for use with a color television kinescope, comprising:

a horizontal deflection winding for producing a horizontal deflection field having an average positive nonuniformity function;

a vertical deflection winding for producing a vertical deflection field having an average negative nonuniformity function coacting with said horizontal deflection winding for producing substantial convergence of the kinescope electron beam at all points on a raster; and means coupled to said yoke for altering said deflection fields to reduce the average nonuniformity of one of said horizontal and vertical deflection fields in the region of the beam-entrance end of said yoke for reducing the sensitivity of said convergence to the position of said yoke relative to said electron beams.

11. A self-converging deflection yoke assembly for use with a color television kinescope, comprising:

a pair of horizontal and a pair of vertical deflection windings;

first magnetic field producing means disposed about said windings for producing fields near the top and the bottom of the beam-exit end of the yoke which fields are of the same polarity as the field produced by said vertical windings during those intervals in which the electron beams are deflected towards the top and bottom, respectively, of said yoke;

second magnetic field producing means disposed at the top and bottom of the inside flare of said yoke adjacent said windings at a position between the beam entrance and said beam exit ends of said yoke for adding a barrel-shaped component to said field produced by said vertical windings for correcting raster distortion in conjunction with said first field producing means; and third magnetic field producing means disposed at the top and bottom of said inside flare at a position between said beam entrance end of said yoke and said second field producing means for adding a pincushion-shaped component to said field produced by said vertical windings for reducing the sensitivity of the convergence to the path of said beams relative to said yoke.

* * * * *